US011111604B2

(12) United States Patent
Dupont

(10) Patent No.: US 11,111,604 B2
(45) Date of Patent: Sep. 7, 2021

(54) METHOD FOR REFINING PLANT FIBERS BY STEAM EXPLOSION

(71) Applicant: LA CHANVRIÈRE, Bar sur Aube (FR)

(72) Inventor: Daniel Dupont, St Etienne les Remiremont (FR)

(73) Assignee: LA CHANVRIÈRE, Bar sur Aube (FR)

( * ) Notice: Subject to any disclaimer, the term of this patent is extended or adjusted under 35 U.S.C. 154(b) by 0 days.

(21) Appl. No.: 16/955,278

(22) PCT Filed: Dec. 18, 2018

(86) PCT No.: PCT/FR2018/053381
§ 371 (c)(1),
(2) Date: Jun. 18, 2020

(87) PCT Pub. No.: WO2019/122694
PCT Pub. Date: Jun. 27, 2019

(65) Prior Publication Data

US 2020/0347548 A1 Nov. 5, 2020

(30) Foreign Application Priority Data

Dec. 19, 2017 (FR) ..... 1762418

(51) Int. Cl.
*D01B 1/14* (2006.01)
*D21B 1/36* (2006.01)
*D21B 1/12* (2006.01)

(52) U.S. Cl.
CPC ..... *D01B 1/14* (2013.01); *D21B 1/12* (2013.01); *D21B 1/36* (2013.01)

(58) Field of Classification Search
CPC ... D01B 1/14; D01B 1/32; D01B 1/34; D01B 1/36; D01B 1/38; D01B 1/42; D21B 1/00; D21B 1/04; D21B 1/12; D21B 1/36
See application file for complete search history.

(56) References Cited

U.S. PATENT DOCUMENTS 5,225,045 A * 7/1993 Watson ..... D21B 1/322 162/4
6,238,516 B1 * 5/2001 Watson ..... D21B 1/026 162/8

(Continued)

FOREIGN PATENT DOCUMENTS

| | | |
|---|---|---|
| CN | 204803675 U | 11/2015 |
| GB | 388561 A | 3/1933 |
| JP | 2005273047 A | 10/2005 |

*Primary Examiner* — Shaun R Hurley
(74) *Attorney, Agent, or Firm* — Volpe Koenig

(57) ABSTRACT

An industrial system for refining plant fibers by steam explosion includes: a pre-chamber; a loader for loading the pre-chamber with sheaves of a fibrous plant, a spark gap arranged under the pre-chamber, a valve upstream of the pre-chamber, a valve separating the pre-chamber from the spark gap when in the closed state and opening a passage with a diameter of at least the smallest of the diameters of the pre-chamber and the spark gap when in the open state; a washing system arranged inside the spark gap for washing the spark gap and dragging the fibers downwards; a mobile basket for receiving fibers with a position under the spark gap for receiving fibers; a liquid-recovery device, arranged under the basket and under the spark gap, a receiving chamber receiving the basket loaded with fibers; and a drying chamber.

17 Claims, 4 Drawing Sheets

(56) References Cited

U.S. PATENT DOCUMENTS

| | | | | |
|---|---|---|---|---|
| 8,961,628 | B2 * | 2/2015 | Ampulski | C10L 9/083 48/61 |
| 2009/0221814 | A1 * | 9/2009 | Pschorn | D21C 1/02 536/128 |
| 2013/0206345 | A1 * | 8/2013 | Dauser | C12M 45/02 162/21 |
| 2015/0233053 | A1 * | 8/2015 | Stromberg | C12M 45/20 162/21 |
| 2019/0032280 | A1 * | 1/2019 | Miyasaka | D04H 1/4274 |

* cited by examiner

METHOD FOR REFINING PLANT FIBERS BY STEAM EXPLOSION

FIELD OF THE INVENTION

The invention relates to the field of refining plant fibers by steam explosion.

BACKGROUND

The refining of so-called industrial or technical fibers has for purpose to separate and to individualize the fibers that comprise a plant stem, in particular hemp. Fibers coming from plants cultivated for industrial purposes are in general used for agricultural, cosmetic, structural or insulation applications for construction, fillers in composite materials and in the textile industry.

The refining is carried out in a known manner by a chemical treatment in a basic medium in order to degrade the non-cellulosic components, in particular pectins and lignin which form a natural adhesive. The chemical refining causes a degradation of the cellulosic fiber, in particular via shortening, resulting in a drop in the mechanical properties and has environmental disadvantages.

Refining by steam explosion has been described in two forms, one form as batch-by-batch treatment and another form continuously with a screw wherein steam is injected. In a treatment of biomass in order to obtain biofuels, both forms are used.

However, obtaining fibers gives rise to other difficulties. Transferring long or semi-long fibers by a valve or by a screw causes build-up and obstruction which cause the productivity of the machine to drop and require interrupting the production and human intervention. Laboratory machines that heavily rely on manpower and which are not suitable for industrial production even after scaling have also been described.

The invention improves the situation.

The Applicant has developed a system and a process that is complete, reliable and that can be automated for refining plant fibers by steam explosion.

SUMMARY

The invention proposes an industrial system for refining plant fibers by steam explosion, comprising:

- a pre-chamber,
- a loader for loading the pre-chamber with sheaves of a fibrous plant,
- a blow-out unit disposed under the pre-chamber,
- a valve upstream from the pre-chamber,
- a valve separating the pre-chamber and the blow-out unit when in the closed state and opening a passage with a diameter of at least the smallest of the diameters of the pre-chamber and the blow-out unit when in the open state,
- a washing system disposed inside the blow-out unit for rinsing the walls of the blow-out unit and driving them downwards,
- a mobile basket for receiving fibers with a position under the blow-out unit for receiving fibers,
- a liquid-recovery device, disposed under the basket and under the blow-out unit,
- a receiving chamber receiving the basket loaded with fibers,
- a spin-drying chamber.

The system is adapted to the mass treatment of fibers. The flow rate can be about 12 tons per day with a very low risk of build-up or obstruction.

In an embodiment, the loader comprises a robotic arm able to load at least the pre-chamber with one or more sheaves at a time. Preferably, the loader is designed to load a single sheaf at a time. The robotic arm can be movable over more than two axes. The loader is able to load several pre-chambers on demand.

In an embodiment, a funnel channel is installed above the upstream valve.

In an embodiment, the system comprises a plurality of pre-chambers, provided with upstream and downstream valves, disposed above said blow-out unit to feed said blow-out unit. Each pre-chamber is designed for pressurizing fibrous stems.

In an embodiment, said basket is a drainer. The permeability of the basket allows the liquid to flow as long as the fibers are in said basket.

In an embodiment, the system comprises a rotating barrel provided with at least the receiving chamber, the spin-drying chamber, and an unloading chamber. The step of spin-drying the fiber is carried out in the receiving basket. The barrel offers a reduced size and can be driven in a compact and simple manner.

In an embodiment, the system comprises a fibrous plant bale opener and a packer of fibrous plant into sheaves of a density less than that of the bales. The sheaves are of dimensions adapted to the pre-chamber and to the valves. The pre-chamber can be provided for two superimposed sheaves.

In an embodiment, the liquid-recovery device comprises a recirculation circuit and a decantation tank. The sludge can be withdrawn from the decantation tank at regular intervals.

In an embodiment, the spin-drying chamber comprises a rotating drive of the basket. The basket can be rotated about the vertical axis thereof causing an increased separation of the liquid and of the fibers.

In an embodiment, the system comprises a dryer downstream of the spin-drying chamber, a carding machine and an additional dryer. The carding machine can be fed with fibers that have a selected humidity level. The material yield of the carding is increased and can exceed 80%, preferably 85%.

The invention also proposes an industrial method for refining plant fibers by steam explosion, comprising steps of:

- loading a pre-chamber with sheaves of a fibrous plant,
- pressurizing fibrous plants in the pre-chamber,
- depressurizing by the opening of a valve to a blow-out unit provoking the explosion of the fibers of the fibrous plant,
- transferring fibers coming from the fibrous plants in the blow-out unit,
- washing of the blow-out unit by driving the fibers downwards,
- transferring fibers to a mobile basket for receiving fibers,
- gravity recovering of liquids under the basket and under the blow-out unit,
- spin-drying of fibers.

In an embodiment, the method comprises prior steps of opening a fibrous plant bale, and subsequent putting into sheaves. The fibrous plants or fibrous stems are thus arranged in groups of chosen volume and density.

In an embodiment, the method comprises posterior steps of drying, preferably for bringing the humidity level between 15 and 40%, of carding and of drying. Carding is optimized.

In an embodiment, the method comprises the steps of recovering the energy of the effluents.

In an embodiment, the fibrous plant is hemp, optionally flax, nettle, ramie, kenaf, miscanthus, jute, agave and sisal.

In an embodiment, the fibers have a length comprised between 15 and 30 mm.

In an embodiment, the fibrous plant is treated with saturated steam at a temperature of at least 130° C., preferably at least 160° C.

In an embodiment, the fibrous plant is treated with saturated steam in two stages, one at a temperature of at least 130° C., the other at a temperature of at least 180° C.

In an embodiment, the fibrous plant is treated with saturated steam in two stages, one at a temperature comprised between 130° C. and 160° C., the other at a temperature comprised between 180° C. and 230° C., preferably between 200 and 220° C.

In an embodiment, the first stage has a duration comprised between 3 and 6 mn and the second stage having a duration comprised between 4 and 8 mn.

In an embodiment, the pressure is comprised between 2.105 and 23.105 Pa.

In an embodiment, the fibers have a xylose content less than 4%, preferably less than 2%.

In an embodiment, the fibers have a pectin content less than 1%, preferably less than 0.9%.

In an embodiment, the fibers have a lignin content less than 1% preferably less than 0.9%.

In practice, plants with long fibers, in general plant stems, are received in the form of high-density bales. The bales are untied and opened mechanically. The stems of plants with long fibers are put into bundles or sheaves of cylindrical shape maintained by a tie, for example a twine of the same fiber. An intermediate storage can be provided allowing for a continuity in production and a homogenization of the humidity level.

A robotic arm loads the sheaves into a pre-chamber provided with an upper valve and with a lower valve. Said upper and lower valves have a diameter at least equal to the diameter of the pre-chamber. The pre-chamber can have a shape of a cylinder of revolution. Several pre-chambers can be associated with a single reactor body, also called a blow-out unit. The upper and lower valves of the pre-chamber, in production, are both closed or one is open and the other closed.

For the introduction of sheaves, the upper valve is open and the lower valve is closed. The pre-chamber can contain one or more sheaves. Then the upper valve is closed. The pre-chamber is pressurized. The lower valve which opens into the blow-out unit can then be opened, causing a sudden drop in the pressure to atmospheric pressure and the explosion of fibrous stems into fibers. Dust and waste also result from the explosion of the fibers.

The blow-out unit has the form of a hopper. The blow-out unit can comprise a cylindrical portion of revolution and a truncated portion disposed under the cylindrical portion of revolution. The blow-out unit is open at the lower end. The blow-out unit opens at the lower end onto a barrel. The blow-out unit comprises a washery, for example in the form of a washing ramp. The washing makes it possible on the one hand to clean the stems of dust or undesirable impurities, for example coming from the explosion of the stem, and on the other hand to drive the fibers downwards. The washing is carried out under pressure.

The barrel comprises several mobile chambers, a first chamber disposed under the blow-out unit, while a second chamber is in a spin-drying position and a third chamber in the unloading position. A basket is disposed in each chamber. The basket in the first chamber receives the fibers under the blow-out unit. A liquid phase drains under the basket. The organic load can be recovered after treatment. The basket in the second chamber holds the fibers during the spin-drying. The spin-drying can take place via centrifugation. The basket in the third chamber is removed from said third chamber.

BRIEF DESCRIPTION OF THE DRAWINGS

Other characteristics and advantages of the invention shall appear better when reading the following description, of examples given for the purposes of information and in a non-limiting way, drawn from drawings wherein.

DETAILED DESCRIPTION OF THE PREFERRED EMBODIMENTS

The drawings and the description hereinafter contain, for the most part, elements of a certain nature. They can therefore not only be used to increase the understanding of the present invention, but also contribute to the definition thereof, where applicable.

The fibrous stems can come from hemp, flax, nettle, ramie, kenaf, miscanthus, jute, agave and sisal.

Figure 1:
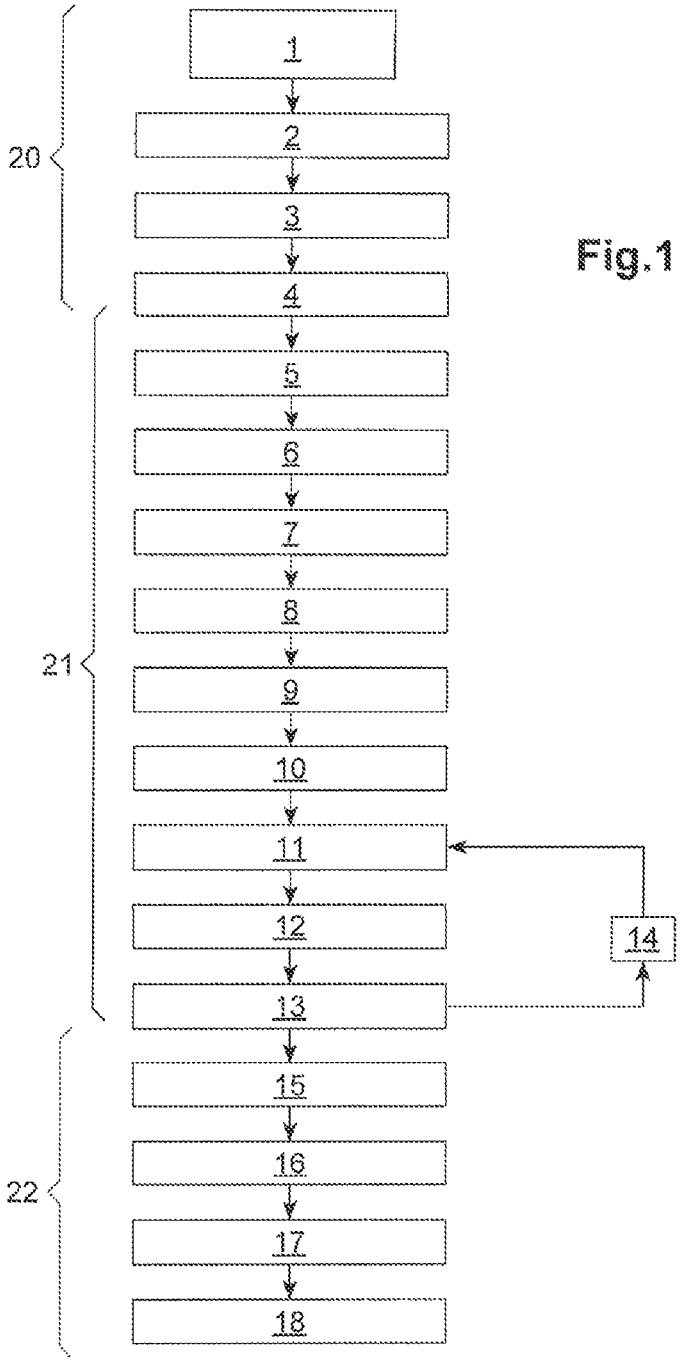
FIG. 1 is a diagram of the steps of the method.

In step no. 1, see FIG. 1, bales of fibrous stems coming from plants with long fibers, for example hemp, are open. The bales come from storage which allows for regularization in production and homogenization in the humidity level.

In step no. 2, the fibrous stems are packed into sheaves having a straight cylindrical shape. The cylindrical shape of revolution makes it possible to easily introduce the sheaves into tubes and optimize the loading of tubular zones. In step no. 3C, the sheaves are transported by a conveyor. This step is optional according to the arrangement of the machines. Machines mounted in the immediate vicinity allow to forego the use of a dedicated conveyor.

In step no. 4, the sheaves grasped by a clamp are presented in an inlet channel. The clamp can be supported by a robotic arm. In step no. 5, a sheaf disposed in the channel is introduced into a pre-chamber through the opening of an inlet valve while an outlet valve is closed.

In step no. 6 the valve for introduction into the pre-chamber is closed again, with the outlet valve remaining closed. In step no. 7, the pre-chamber is pressurized, for example at a pressure comprised between 2.105 Pa and 23.105 Pa.

In step no. 8, the outlet valve is opened. The pressure in the pre-chamber drops in less than 500 ms to atmospheric pressure. The fibrous stem explodes into fibers. The pectin and the lignin are in solution form. The fibers descend via gravity into the blow-out unit which comprises a tank. In step no. 9, the pre-chamber outlet valve is closed again after the descent of the sheaf into the blow-out unit. The preceding steps can then be repeated while the other steps are unfolding. More precisely, step no. 5 can be repeated at the end of step no. 9. Steps no. 5 to 9 can be executed in parallel in several pre-chambers feeding a single blow-out unit. Said execution in parallel can be slightly offset in time in such a way that the openings of the outlet valves are offset by at least a few seconds.

In step no. 10, the washing of the blow-out unit makes it possible to drive the fibers downwards. The blow-out unit can contain the fibers that correspond to several sheaves. In step no. 11, the fibers pass from the bottom of the blow-out unit to a basket. A draining takes place. The liquids are recovered in a tank forming the decanter.

In step no. 12, the basket containing the drained fibers passes through a spin-drying station. The spin-drying can be carried out by centrifugation, in particular by rotating the basket. Step no. 12 can comprise a first substep of spin-drying followed by a second substep of spin-drying, in particular in a machine with a higher speed. The spin-drying in two steps separated by a rest period allows for a more effective spin-drying. Step no. 12 can also include a transferring of the basket loaded with fibers from one machine to another.

In step no. 13, the basket containing the spun-dry fibers passes into an unloading station. The basket is then emptied of the fibers that it contains, by overturning said basket or by blowing or by pushing the fibers. In step no. 14, the basket returns under the blow-out unit to again be loaded with fibers, cf. step no. 11.

In step no. 15, the fibers are dried by bringing them to a humidity level comprised between 15 and 40%. In step no. 16, the fibers are carded. Carding consists of combing the fibers. In step no. 17, a final drying of the fibers is carried out. In step no. 18, the dried fibers are packed, for example in bundles.

Figure 2:
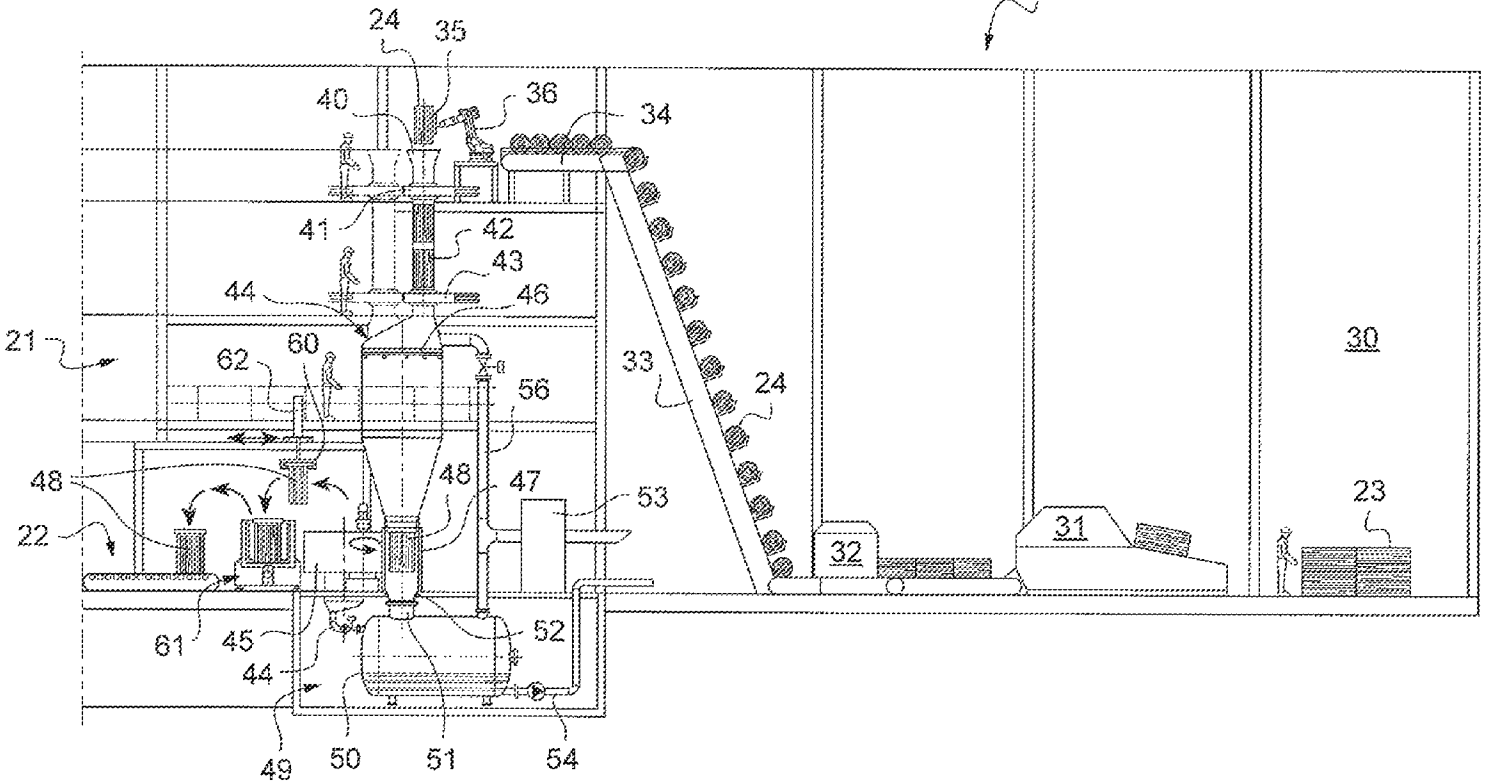
FIG. 2 is a general view of the system, upstream portion.
Figure 3:
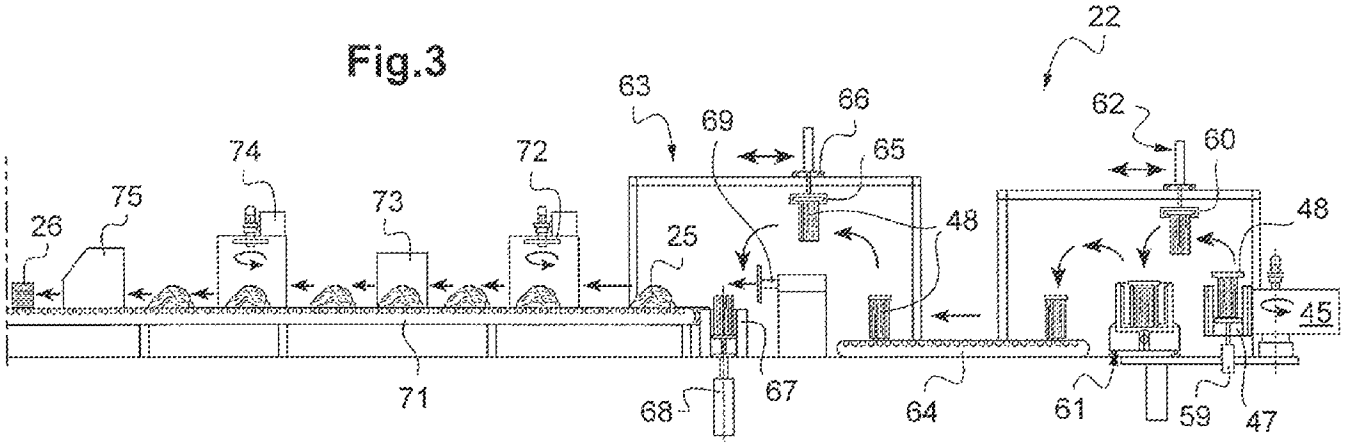
FIG. 3 is a general view of the system, downstream portion, according to an embodiment.
Figure 4:
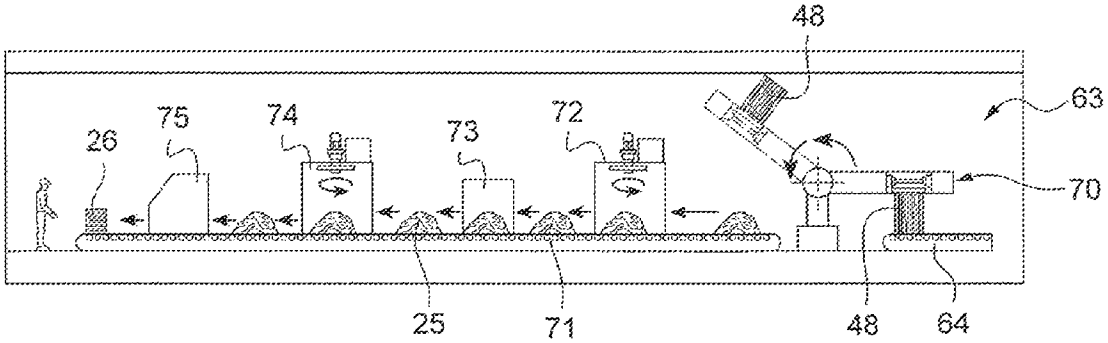
FIG. 4 is a general view of the system, downstream portion, according to another embodiment.

As can be seen in FIGS. 2 to 4, the installation for treating fibrous stems is intended for the production of fibers for industrial use. The installation comprises a supply zone 20 with fibrous stems located upstream from a reactor 21, the reactor 21 and a treatment zone 22 of fibers located downstream from the reactor. Operators have been shown to show the scale of the installation, without this indicating a manual operation.

More precisely, the installation comprises a hall 30 for receiving and storing raw materials, here fibrous stems. The fibrous stems are received in the form of square or parallelepiped 23. Downstream from the hall 30, a fibrous stem bale opener 31 is provided. The opener 31 sections the ties of the bale and spreads out the fibrous stems in order to reduce the density thereof.

Downstream from the opener 31 is installed a bundling machine or packing machine 32 into sheaves 24. A sheaf 24 is formed from fibrous stems gathered together in a cylinder of revolution. The dimensions of a sheaf 24 depend on the dimension of the pre-chamber. The diameter is chosen according to the diameter of the inlet of the reactor described hereinafter.

Downstream from the packing machine 32 a conveyor 33 is installed. The conveyor 33 is able to displace the sheaves 24 from one point to another of the supply zone 20. In the embodiment shown, the conveyor 33 is an elevating conveyor. Alternatively, the conveyor 33 can be horizontal or descending. The conveyor 33 can also form a buffer storage.

Downstream from the conveyor 33, a storage table 34 is installed. The storage table 34 can be motorized in order to progressively move the sheaves 24 forward. Downstream from the storage table 34, the installation comprises a loading clamp 35. The clamp 35 can be supported by a robotic arm 36. The clamp 35 is provided to grasp a sheaf 24 and to orient it in a direction that is suitable for entry into the reactor 21. The members of the installation located in the hall 30 with the robotic arm 36, in the direction from upstream to downstream, are mounted in the supply zone 20.

The reactor 21 is organized vertically in descent from upstream to downstream. The reactor 21 comprises a tapered channel 40. The channel 40 is installed in the vicinity of the clamp 35. In the embodiment shown, the reactor 21 comprises three channels 40. The channels 40 have parallel axes. The channels 40 have an upstream tapered portion flaring in the upstream direction and a downstream cylindrical portion of revolution.

A valve 41 is disposed downstream of each channel 40. The valve 41 is liquid- and gas-tight. The valve 41 has a passage in the open state with a diameter at least equal to the minimum inner diameter of the channel 40. The valve 41 is controlled.

The reactor 21 comprises pre-chambers 42, each associated with a valve 41. The pre-chamber 42 has the form of a cylindrical tube of revolution. The diameter of the pre-chamber 42 is substantially equal to the minimum inner diameter of the channel 40. The pre-chamber 42 can contain at least one sheaf 24, here two. The pre-chamber 42 is provided with a pressurizing member, for example with steam.

A valve 43 is disposed downstream from each pre-chamber 42. The valve 43 is liquid- and gas-tight. The valve 43 has a passage in the open state with a diameter at least equal to the minimum inner diameter of the pre-chamber 42. The valve 43 is controlled. The valve 43 is of the quick opening type (less than 500 ms).

Downstream from the valve 43, the reactor 21 comprises a blow-out unit 44. The top of the blow-out unit 44 is pierced with holes closed off by the valves 43. The blow-out unit 44 comprises a central portion in the shape of a cylinder of revolution disposed under the top and a lower tapered portion with a diameter that decreases downwards. The blow-out unit 44 can have a volume comprised between 5 and 20 m3. The lower end of the blow-out unit 44 is open and opens onto a multi-chamber rotating barrel 45. The rotation of the barrel 45 can be discontinuous. Advantageously, the diameters of the channel 40, the open valve 41, the pre-chamber 42 and the open valve 43 are equal, facilitating the descent of the treated material: sheaves of fibrous stems, then fibers.

Figure 5A:
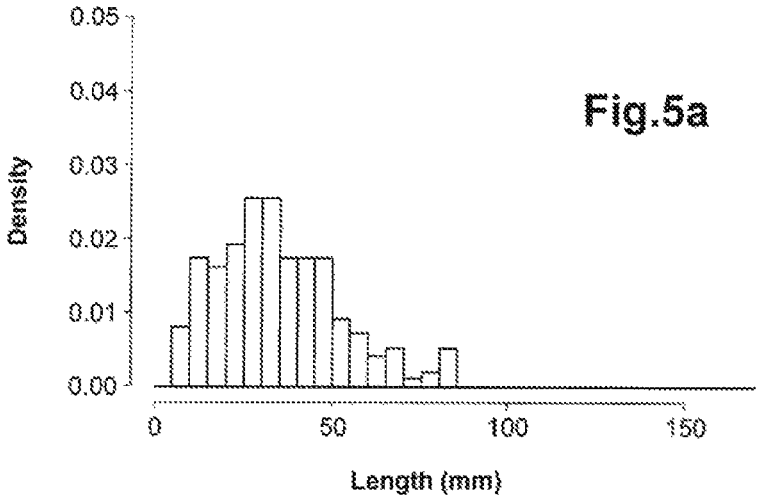
FIGS. 5*a* and 5*b* are diagrams of fiber lengths according to two embodiments.

The fibrous stems of the sheaves 24 can be introduced into the pre-chamber 42 with the lower valve 43 closed and the upper valve 41 open. Then, the upper valve 41 is closed. The fibrous stems, here hemp, of the sheaves 24 can be treated in the pre-chamber 42 with saturated steam for 5 mn at 140° C. then for 5 mn at 200° C. Fibers with a glucose 69.7%, xylose 3.6%, lignin 0.85% and pectin 0.87% composition are obtained. The distribution of the length of fibers is in FIG. 5*a*.

Figure 5B:
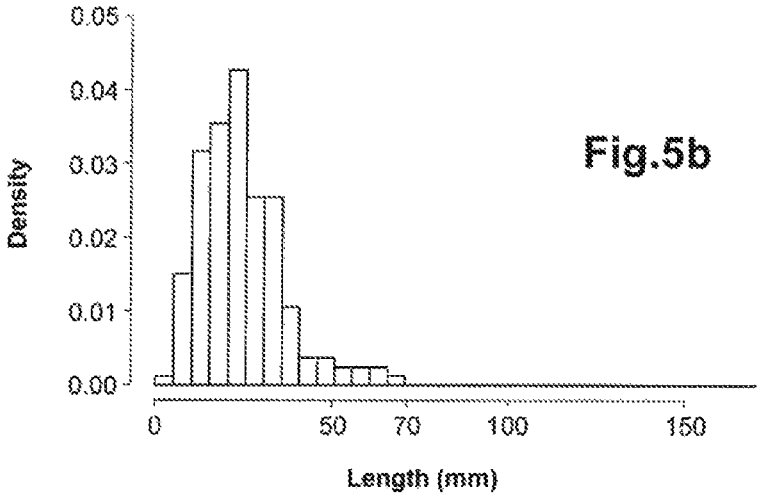

Preferably, the fibrous stems can be treated with saturated steam for 5 mn at 140° C. then for 7 mn at 220° C. The lignin, pectin and especially xylose contents are reduced. Fibers with a glucose 73.2%, xylose 1.9%, lignin 0.75% and pectin 0.79% composition are obtained. In comparison, the composition of the fibrous stem of hemp before explosion is glucose 40.1%, xylose 7.9%, lignin 3.2% and pectin 21%. The distribution of the length of fibers is in FIG. 5*b*. The fibers are shorter than in the preceding mode, in particular absence of fibers with a length greater than 70 mm and a low amount of fibers with a length greater than 50 mm. The lengths are more homogeneous with a maximum frequency greater by more than 40%.

The compositions hereinabove were determined by acid hydrolysis and analysis of simple sugars by ion chromatography. The lignin content was determined by gravimetry. The pectin content was determined by spectroscopic analysis.

During the treatment, the pre-chamber 42 is closed off. Valves 41 and 43 are closed. Then valve 43 is opened causing a sudden drop in the pressure in the pre-chamber 42. The sudden pressure drop causes the explosion of the fibrous stems into fibers and the release of residues of non-cellulosic components, in particular pectins and lignins used as a natural adhesive for the fibrous stem. The fibers coming from exploded fibrous stems descend via gravity in the blow-out unit 44. The material yield is comprised between 85 and 90%.

A washing ramp 46 is disposed inside the blow-out unit 44. The washing ramp 46 is activated to wash the blow-out unit 44 with pressurized water. The washing also helps the fibers to descend towards the bottom of the blow-out unit 44. The washing water is water without any voluntary adding of soda. The washing water is water from a drinking water supply mains.

The barrel 45 is provided with a plurality of chambers 47. The chambers 47 are open at the two ends thereof. The barrel 45 rotates about an axis parallel to the axis of the blow-out unit 44, in general a vertical axis. The number of chambers 47 of the barrel 45 is at least three. The rotation of barrel 45 is discontinuous. The minimum number of chambers 47 corresponds to the number of active positions also called stations. Each chamber 47 is provided to receive a basket 48 temporarily. The basket 48 can be made from perforated sheet metal or from metal wire. The basket 48 retains the fibers and allows the liquids to pass. The fiber receiving chamber 47 is located under the lower end of the blow-out unit 44.

The fibers driven by the washing water fall under the blow-out unit 44 and pass into the basket 48. The basket 48 stops the movement of the fibers. The fibers are drained in the basket 48. Once the basket 48 is filled with fibers, the barrel 45 is rotated and an empty basket is presented at the receiving station under the blow-out unit 44. The basket 48 filled with fibers is conveyed to a spin-drying station. At the spin-drying station, a rotating drive of the basket 48 is provided. An additional quantity of water is extracted from the fibers by centrifugal effect. Once the fibers of the basket 48 are spun-dried, the barrel 45 is rotated. The barrel 45 conveys the spun-dried fibers in the basket 48 to an unloading station wherein the basket 48 is extracted from the chamber 47 of the barrel 45.

In the case with a barrel 45 with three chambers 47, each chamber corresponds to a station. The loading of a basket with fibers under the blow-out unit 44 and the draining of the fibers, the spin-drying of fibers in a basket filled with fibers drained beforehand, and the extracting of a basket of spun-dried fibers outside the chamber 47 as well as the introducing of an empty basket in the chamber 47 can be carried out simultaneously. A number of chambers 47 greater than three can be provided, in particular to allow for additional draining between the loading station and the spin-drying station, or to allow for the introduction of an empty basket into a chamber 47 after the unloading station and before the receiving station. To this effect, an empty basket reloading station can be provided. In this case, the barrel 45 comprises at least four chambers 47.

Under the receiving chamber 47, the reactor 21 comprises a liquid-recovery device 49. The liquid-recovery device 49 is disposed under the basket 48 and under the blow-out unit 44. The liquid-recovery device 49 comprises a decantation tank 50. The decantation tank 50 is provided with an upper opening 51 that receives the draining liquids. Between the upper opening 51 and the barrel 45, can be disposed a truncated cone 52 that forms a funnel. The decantation tank 50 can have the form of an elongated cylinder with a horizontal axis. The decantation tank 50 also receives liquids coming from the spin-drying station through a pipe 55.

Downstream from the decantation tank 50 a degassing member 53 can be provided connected to the top of the decantation tank 50. A pipe 54 disposed in the lower portion of the decantation tank 50 allows for the removal of sludge.

A degassing orifice connected to a pipe 56 can be provided in the vicinity of the top of the blow-out unit 44. The pipe 56 is connected to the degassing member 53. The degassing member 53 is common to the blow-out unit 44 and to the decantation tank 50.

The unloading station of the basket containing spun-dried fibers is associated with a clamp 60 that grasps the basket 48 by having it exit the chamber 47. Alternatively or in addition, the exit of the basket 48 outside the chamber 47 can be carried out by a linear actuator 59 disposed in the lower position and pushing the basket 48 upwards. The basket 48 enters into the downstream treatment zone 22.

In the treatment zone 22 a spin-dryer 61 is provided. The spin-dryer 61 can have the form of a rotating drum. The spin-dryer 61 receives a basket 48 loaded with fibers that have already been subjected to a first spin-drying in the barrel 45 and intended to be subjected to a second spin-drying. The transferring of the basket 48 loaded with fibers from the chamber 47 to the spin-dryer 61 can be carried out by the clamp 60. The clamp 60 can be carried by a lifting robot 62.

In the treatment zone 22 an unloading machine 63 for unloading the fibers from a basket 48 is provided. The unloading machine 63 is disposed downstream from the spin-dryer 61. A conveyor 64 can be disposed between the spin-dryer 61 and the unloading machine 63.

In a first embodiment shown in FIG. 3, the unloading machine 63 comprises a clamp 65 supported by a lifting robot 66 for displacing a basket loaded with fibers at least in a vertical plane, and an unloading chamber 67 provided to receive the basket 48 loaded with fibers and a pushing member 68 acting in the bottom of the unloading chamber 67 by pushing the fibers while still leaving the basket 48 in place in the unloading chamber 67. The pushing member 68 can comprise an actuator and a plurality of fingers passing in orifices of the bottom of the basket 48. The unloading machine 63 also comprises a pusher 69 with a horizontal axis. The pusher 69 is provided to push the fibers located above the basket 48 towards a conveyor. The pusher 69 can comprise a linear actuator and a blade or a rake. The fibers are then in piles 25.

A second embodiment is shown in FIG. 4. FIG. 4 partially shows the conveyor 64, with the members upstream from the conveyor 64 being common with the first embodiment. The unloading machine 63 comprises a turning device 70 of the basket 48 loaded with fibers. The turning device 70 grasps the basket 48 loaded with fibers and turns it over in such a way that the bottom of the basket 48 is in the upper position and the opening of the basket in the lower position. The fibers then fall from the basket 48 into piles 25.

In the treatment zone 22 a substantially horizontal conveyor 71 is provided. The conveyor 71 receives the fibers coming from the unloading machine 63. The conveyor 71 transports a plurality of piles 25 of fibers. Above the path of the fibers on the conveyor 71, the installation comprises, from upstream to downstream, a first dryer 72 for drying the fibers in piles 25, a carding machine 73, a second dryer 74 for drying the fibers in piles 25 and a packer 75.

The first dryer 72 comprises a motorized fan. The second dryer 74 can comprise the same elements as the first dryer 72. The carding machine 73 can comprise one or more metal combs for separating and aligning the fibers positioned as a mattress on the conveyor 71. The carding yield is increased with a fiber humidity level comprised between 15 and 40%, preferably between 20 and 35%, more preferably between 25 and 34%.

A carding of dried fibers with a humidity level comprised between 4 and less than 15% causes the breaking of a portion of fibers and therefore generates dust and a shortening of said fibers. It may be interesting to do without post-carding drying. In this case, the carded fibers are packed directly, in particular in view of the spinning.

The packer 75 gathers the fibers together into several piles 25. The packer 75 ties the fibers into tied bundles 26, for example parallelepiped. The fibers, in particular hemp, have a length comprised between 15 and 30 mm.

The invention offers a physical treatment of fibrous plants in order to obtain fibers. The treatment is without solvent, without the supply of bases.

The invention claimed is:

1. Industrial system for refining plant fibers comprising:
- a pre-chamber provided with a pressurizing member,
- a loader for loading the pre-chamber with sheaves of a fibrous plant,
- a blow-out unit disposed under the pre-chamber,
- a valve upstream from the pre-chamber,
- a valve separating the pre-chamber and the blow-out unit when in a closed state and opening a passage with a diameter of at least a smallest of the diameters of the pre-chamber and the blow-out unit when in an open state,
- a washing system disposed inside the blow-out unit for washing the blow-out unit and dragging the fibers downward,
- a mobile basket for receiving fibers with a position under the blow-out unit for receiving fibers,
- a liquid-recovery device, disposed under the basket and under the blow-out unit,
- a receiving chamber receiving the basket loaded with fibers, and
- a spin-drying chamber.

2. The system according to claim 1, wherein the loader comprises a robotic arm configured to load at least the pre-chamber with one or more sheaves at a time.

3. The system according to claim 1, further comprising a plurality of pre-chambers disposed above said blow-out unit to feed said blow-out unit.

4. The system according to claim 1, wherein said basket is a drainer.

5. The system according to claim 1, further comprising a rotating barrel provided at least with the receiving chamber, the spin-drying chamber, and an unloading chamber.

6. The system according to claim 1, further comprising a fibrous plant bale opener and a packer of fibrous plants into sheaves of a density less than that of the bales.

7. The system according to claim 1, wherein the liquid-recovery device comprises a recirculation circuit and a decantation tank.

8. The system according to claim 1, wherein the spin-drying chamber comprises a rotating drive of the basket.

9. The system according to claim 1, further comprising a dryer downstream of the spin-drying chamber.

10. Industrial method for refining plant fibers comprising:
- loading a pre-chamber with sheaves of a fibrous plant,
- pressurizing fibrous plants in the pre-chamber,
- depressurizing by the opening of a valve to a blow-out unit provoking the explosion of the fibers of the fibrous plant,
- transferring fibers coming from the fibrous plants in the blow-out unit,
- washing of the blow-out unit by driving the fibers downwards,
- transferring fibers to a mobile basket for receiving fibers,
- gravity recovering of liquids under the basket and under the blow-out unit,
- spin-drying of the fibers.

11. The method according to claim 10, further comprising:
- opening fibrous plant bales, then putting into sheaves prior to loading the pre-chamber.

12. The method according to claim 10, further comprising, after spin drying:
- drying, bringing the humidity level to between 15 and 40%, carding; and drying.

13. The method according to claim 10, wherein pressurizing fibrous plants in the pre-chamber comprises treating the fibrous plants with saturated stream at a temperature of at least 130° C.

14. The method according to claim 13, wherein pressurizing fibrous plants in the pre-chamber comprises treating the fibrous plants with saturated steam in two stages, in a first stage at a temperature of at least 130° C., at most 160° C., and in a second stage at a temperature of at least 180° C., at most 230° C.

15. The method according to claim 14, wherein the first stage has a duration comprised between 3 and 6 mn and the second stage has a duration comprised between 4 and 8 mn.

16. The system according to claim 9, further comprising a carding machine downstream of the dryer and an additional dryer downstream of the carding machine.

17. The method according to claim 10, wherein pressurizing fibrous plants in the pre-chamber comprises treating the fibrous plants with saturated steam at a temperature of at least 160° C.

* * * * *